US009308615B2

(12) United States Patent
Yoshizuru

(10) Patent No.: US 9,308,615 B2
(45) Date of Patent: Apr. 12, 2016

(54) HORIZONTAL DOUBLE DISC SURFACE GRINDING MACHINE

(71) Applicant: DAISHO SEIKI CORPORATION, Ikeda-shi (JP)

(72) Inventor: Shoji Yoshizuru, Ikeda (JP)

(73) Assignee: DAISHO SEIKI CORPORATION, Nishinomiya-shi (JP)

( * ) Notice: Subject to any disclaimer, the term of this patent is extended or adjusted under 35 U.S.C. 154(b) by 89 days.

(21) Appl. No.: 14/147,882

(22) Filed: Jan. 6, 2014

(65) Prior Publication Data

US 2015/0140908 A1 May 21, 2015

(30) Foreign Application Priority Data

Nov. 15, 2013 (JP) ..... 2013-236592

(51) Int. Cl.
*B24B 7/17* (2006.01)
*B24B 7/06* (2006.01)

(52) U.S. Cl.
CPC .... *B24B 7/17* (2013.01); *B24B 7/06* (2013.01)

(58) Field of Classification Search
CPC ..... B24B 9/102; B24B 27/0023; B24B 7/24; B24B 7/26; B24B 7/17; B24B 37/08; B24B 3/54; B24B 11/06; B24B 5/355; B24B 5/18; B24B 7/06; B24B 33/02; B24B 5/40
USPC ..... 451/184, 261, 262, 267, 245, 336, 51
See application file for complete search history.

(56) References Cited

U.S. PATENT DOCUMENTS

| | | | | | |
|---|---|---|---|---|---|
| 1,659,092 | A | * | 2/1928 | Gardner | 451/261 |
| 1,862,894 | A | * | 6/1932 | Hughes | 451/331 |
| 2,169,252 | A | * | 8/1939 | Koether | 451/261 |
| 2,618,910 | A | * | 11/1952 | Cadman | 451/261 |
| 2,636,322 | A | * | 4/1953 | Carlson et al. | 451/261 |
| 3,160,996 | A | * | 12/1964 | Dunn | B24B 7/12 221/279 |
| 3,803,769 | A | * | 4/1974 | Fallon et al. | 451/261 |

FOREIGN PATENT DOCUMENTS

JP S60-259364 12/1985

* cited by examiner

*Primary Examiner* — Robert Rose
(74) *Attorney, Agent, or Firm* — Kratz, Quintos & Hanson, LLP

(57) ABSTRACT

A horizontal double disc surface grinding machine of through field type wherein a plate work in vertical posture is induced between grinding wheels by V-belts and work guiding plates. A work falling prevention member is disposed in a work transfer area. The work falling prevention member is provided with an upper plate, a middle plate, and a lower plate, and the middle plate is inserted to a gap between V-belt single bodies.

2 Claims, 13 Drawing Sheets

HORIZONTAL DOUBLE DISC SURFACE GRINDING MACHINE

BACKGROUND OF THE INVENTION

1. Field of the Invention

This invention relates to a horizontal double disc surface grinding machine.

2. Description of the Related Art

Conventionally, as a horizontal double disc surface grinding machine, a grinding machine of through-feed type, in which a work is made continuously and linearly pass between facing flat faces of grinding wheels, is known (refer to Japanese Patent Provisional Publication NO. S60-259364).

For example, a horizontal double disc surface grinding machine, a grinding machine of through-feed type as shown in a top view of FIG. 14 and an enlarged explanatory view of a principal portion of FIG. 15, is known.

A pair of left and right endless V-belts, holding and giving feed $F_0$ to a plate work 32 such as a circular plate and a ring plate in vertical posture, and, a pair of left and right straight work guiding plates 35, receiving the work 32 with the vertical posture on a downstream side of the V-belts 33 and guiding the work 32 between the grinding wheels 34, are provided.

Each of the V-belts 33 is suspended on a driving roller 36 and a following roller 37, and the V-belt 33 is moved in an arrow $F_{33}$ direction by rotation of the driving roller 36 in an arrow $M_{36}$ direction. As clearly shown in FIG. 14, parallel running portions 33A of the left and right V-belts 33 hold the work 32 and give the feed to the work 32 in the arrow $F_{33}$ direction in mutually approximate state, the V-belts 33 are separated each other along the rotation of the rollers 36 after going over a straight line $L_1$ connecting axis points $L_{36}$ of the rollers 36.

Although the work guiding plate 35 is disposed with insertion within an approximately triangular area where the V-belts 33 are separated each other, a relatively large gap has to be formed between an upstream end 35A of the work guiding plate 35 and the V-belt 33 for the running of the V-belt 33, dimensional tolerance of the V-belt 33, vibration, etc. Therefore, a work transfer area Z from the V-belt 33 to the plate 35 is formed rather large in top view, the work 32 may be inclining and falling as shown in FIG. 15 in the transfer area Z (when the outline of the work 32 is small), stopped by the upstream end 35A of the guiding plate 35, and not transferred to the guiding plate 35 (this is called transfer anomaly in some cases).

When the above-mentioned transfer anomaly is generated, facility (the grinding machine) must be temporarily stopped, and working ratio of the facility is decreased. Further, in the case of the facility stop, although the work left between (the left and right) grinding wheels is ground again when the facility is re-started, working accuracy is not stable and working defects ratio is increased.

Therefore, it is an object of the present invention to provide a grinding machine in which the transfer from the V-belt to the guiding plate is conducted stably and smoothly (preventing the falling and stopping of the work) even if the work is small, the facility stop along the conventional transfer anomaly is prevented, working ratio of the facility is increased, and the defect generation ratio of the working accuracy is reduced.

BRIEF DESCRIPTION OF THE DRAWINGS

The present invention will be described with reference to the accompanying drawings in which.

DESCRIPTION OF THE PREFERRED EMBODIMENTS

Figure 1:
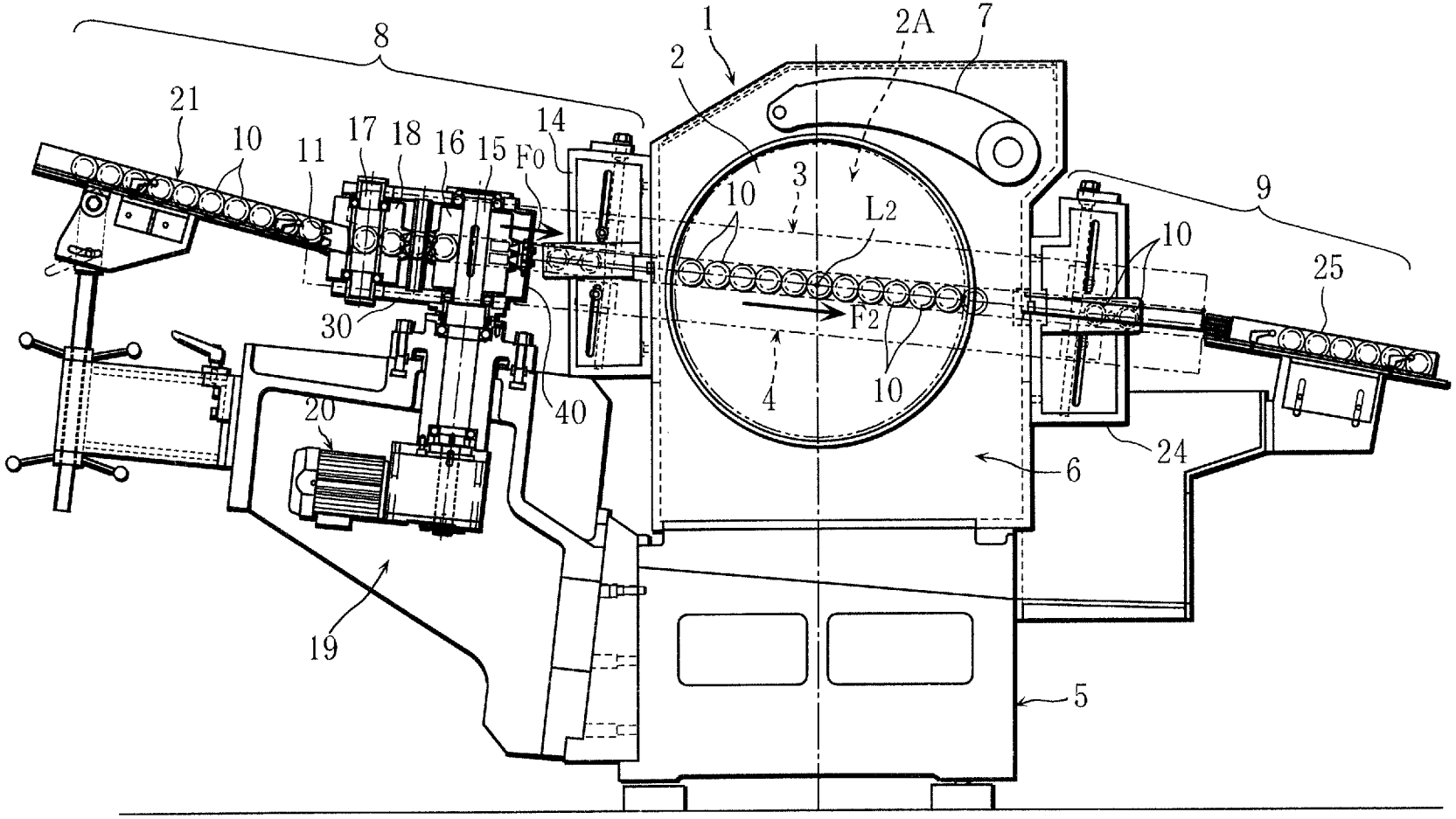
FIG. 1 is a side view with partial cross section showing an embodiment of the present invention.

The present invention will now be described according to the embodiments shown in the drawings. FIG. 1 through FIG. 5 show an embodiment of the present invention.

Figure 2:
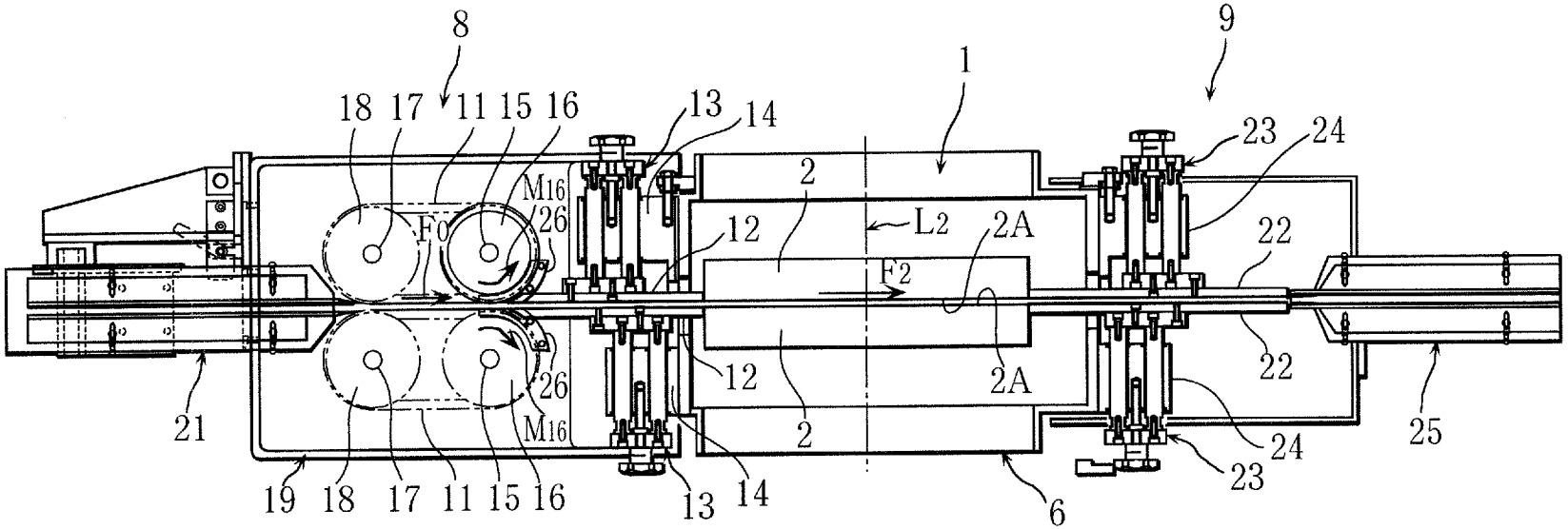
FIG. 2 is a top view.

FIG. 1 is a side view and FIG. 2 is a top view showing an embodiment of a horizontal double disc surface grinding machine. In FIG. 1 and FIG. 2, a mark 1 represents a grinding machine main body, and a pair of circular (rotating) grinding wheels 2 is disposed as to freely rotate around a horizontal axis $L_2$ and driven to rotate by a driving means (not shown in figures).

A plate work 10, passing between facing two flat faces 2A of the pair of grinding wheels 2 linearly (in one straight direction) as an arrow $F_2$ with vertical posture, is ground on both faces simultaneously.

Marks 3 and 4 show an upper rail and a lower rail of plate metal disposed parallel with a vertical interval slightly larger than an outer diameter dimension of the work 10, and, the upper and lower rails 3 and 4, in the side view (shown in FIG. 1), inserted to a gap between the flat faces 2A of the grinding wheels 2, go between the grinding wheels 2 slightly inclined downward to a downstream side on or near the axis $L_2$.

The work 10 is consecutively fed in the arrow $F_2$ direction (passing linearly), and vertical both sides of the work 10 are ground to flat faces. As described above, the present invention relates to a horizontal double disc surface grinding machine.

The grinding machine main body 1 is provided with a base portion 5 and a machine frame portion 6 disposed on the base portion 5, and, the grinding wheels 2 are disposed in the machine frame portion 6, and a dressing arm 7 is disposed for dressing the grinding wheels 2.

Then, a work supplying device 8 to feed the work 10 serially to the grinding machine main body 1 is disposed on an upstream side (left side of FIG. 1), and a work delivery device 9 to serially extract the work 10 ground by the grinding machine main body 1 is disposed on a downstream side (right side of FIG. 1).

The work supplying device 8 is provided with a pair of left and right endless V-belts 11 to hold the work 10 in vertical posture and give feed $F_0$, and a pair of left and right work guiding plates 12 to receive and induce the work 10 in vertical posture between (the flat faces 2A of) the grinding wheels 2 on a downstream side of the V-belts 11.

The position of each of the work guiding plates 12 in lateral direction can be changed by a left-right (position) adjusting mechanism 13, and an interval dimension of the pair of work guiding plates 12 attached to a frame 14 is freely adjusted. The frame 14 is fixed to the machine frame portion 6.

Each of the V-belts 11 is endlessly suspended onto a driving roller 16 fixed to an approximately vertical driving shaft 15 and a following roller 18 fixed to an approximately vertical following shaft 17, and ellipse in top view.

A driving motor 20 is disposed on a sub base portion 19 fixed to an upstream side face of the base portion 5 of the grinding machine main body 1 to rotate the driving shaft 15 in an arrow $M_{16}$ direction through a reducer.

A mark 21 represents a chute on work supplying side angle-adjustably attached to the sub base portion 19 as to incline downward to the downstream side, and the downstream end of the chute 21 is disposed to correspond to an interval of the following rollers 18 of the pair of V-belts 11.

Next, the work delivery device 9 has a pair of left and right work extraction plates 22 to guide the work 10 in vertical posture just after the grinding to the right direction in FIG. 1 and FIG. 2 (namely, to the downstream side). The position of each of the work extraction plates 22 in lateral direction can be changed by a left-right (position) adjusting mechanism 23, and an interval dimension of the pair of work extraction plates 22 attached to a frame 24 is freely adjusted. The frame 24 is fixed to the machine frame portion 6.

And, a chute 25 on work extracting side inclining downward to the downstream side is attached to the downstream side of the work extraction plates 22 to be straight in top view.

Figure 3:
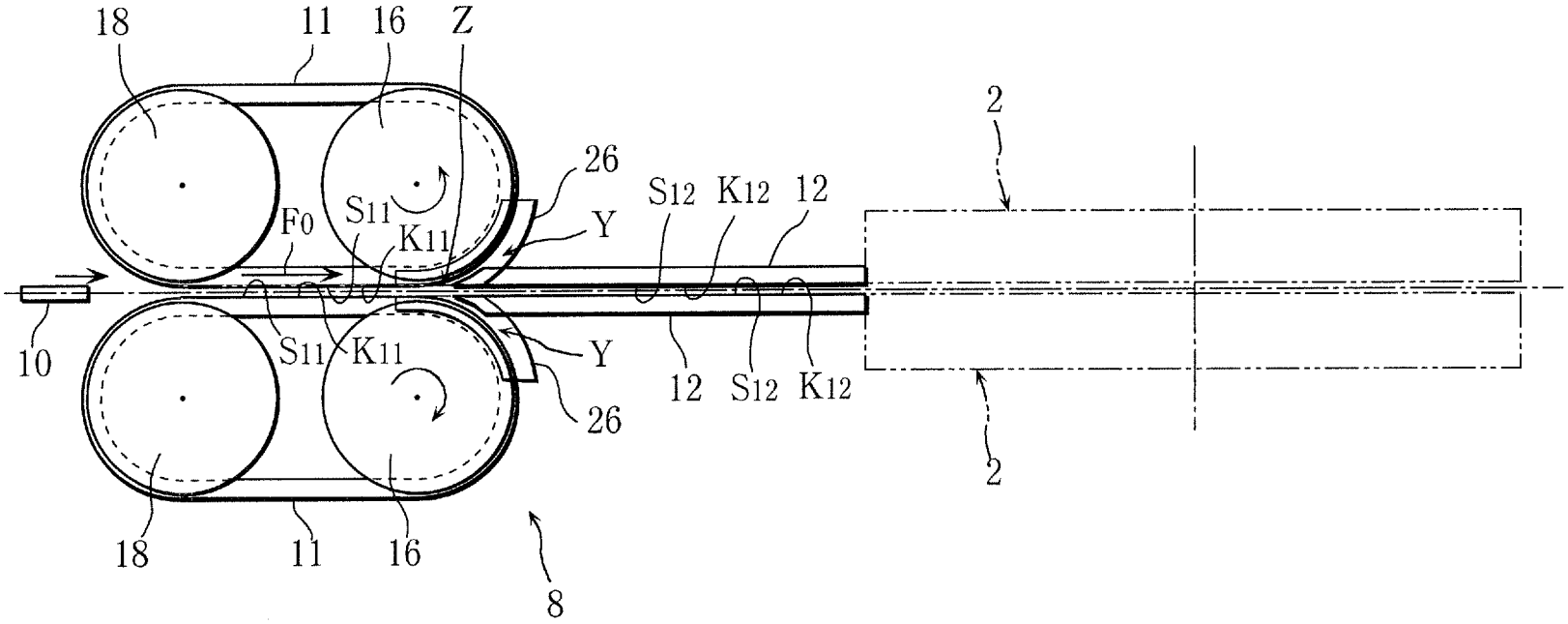
FIG. 3 is a schematic top view of a principal portion.
Figure 4:
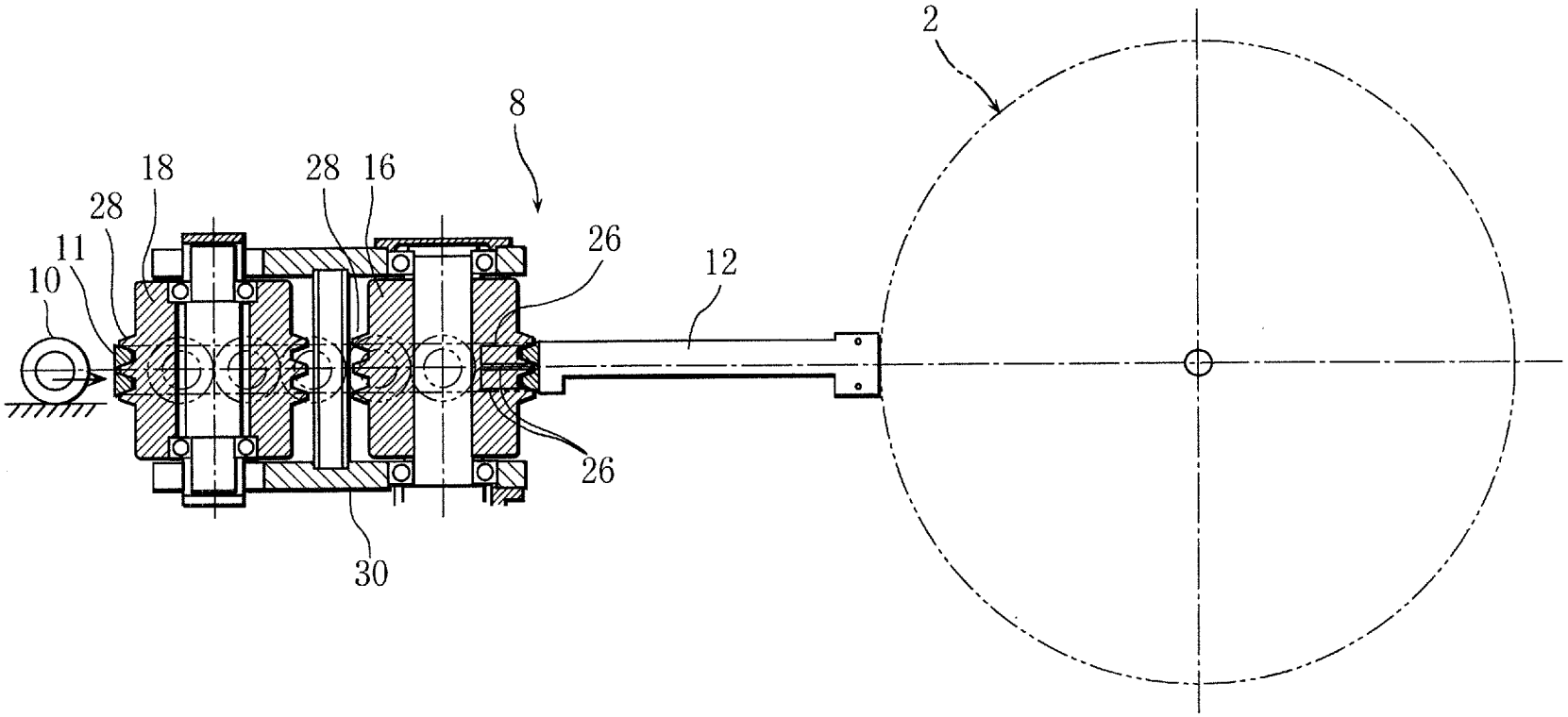
FIG. 4 is a schematic side view of a principal portion with partial cross section.
Figure 5:
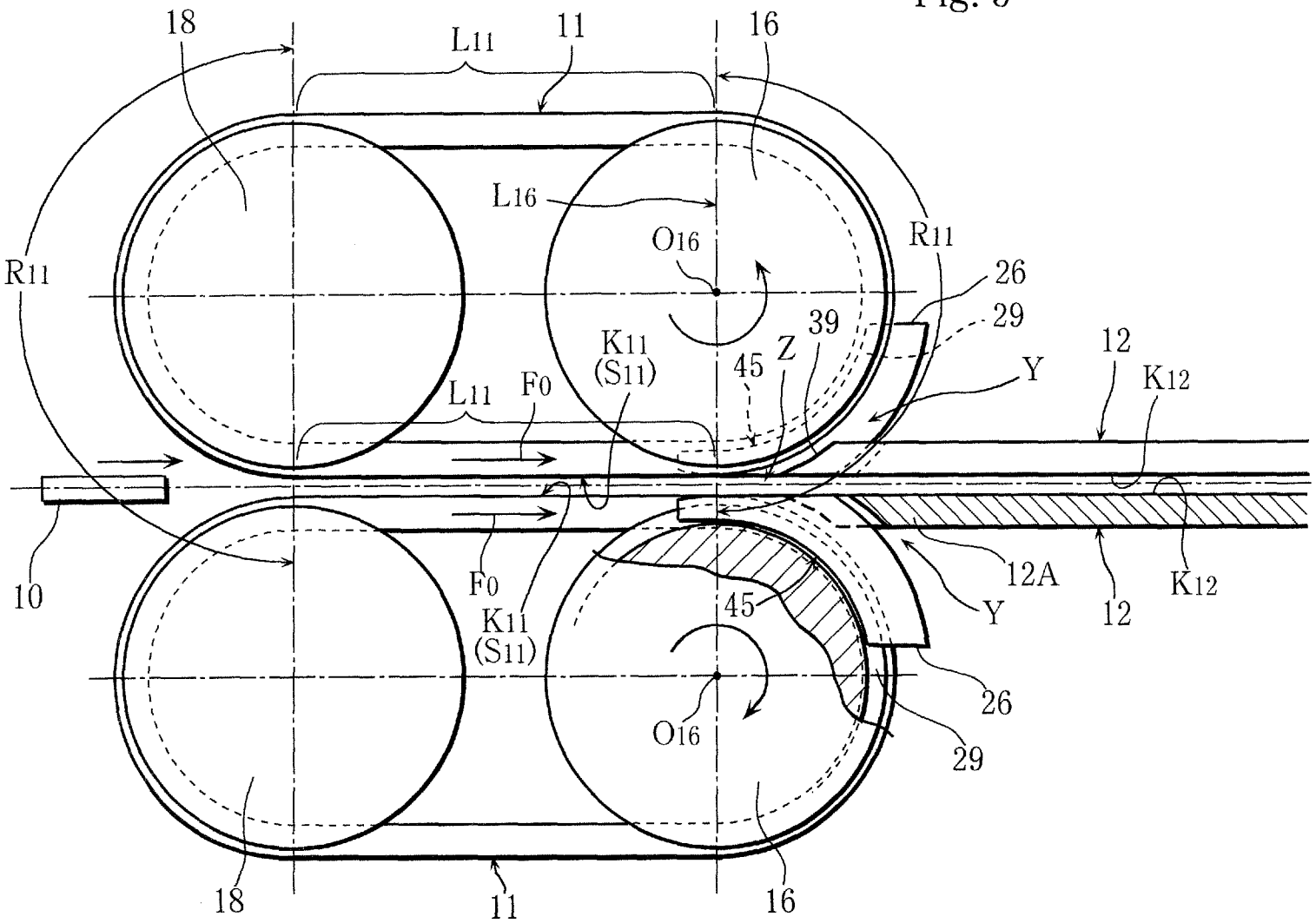
FIG. 5 is an enlarged explanatory view of a principal portion.

FIG. 3 and FIG. 4 are showing enlarged principal portions of FIG. 2 and FIG. 1 respectively, and FIG. 5 is showing an enlarged principal portion of FIG. 3.

As shown in FIG. 3, FIG. 4, FIG. 5, FIG. 1, and FIG. 2, a work falling prevention member 26 is disposed in a work transfer area Z from the V-belt 11 to the work guiding plate 12 in the work supplying device 8 provided with the V-belts 11 and the work guiding plates 12.

In the embodiment shown in FIG. 1 through FIG. 5 and FIG. 6 showing a perspective view of a principal portion, each of the left and right V-belts 11 is composed of two belt single bodies 11A disposed parallel on upper and lower positions with a predetermined gap $G_{11}$.

Two concave peripheral grooves 27 for suspending V-belt are formed on each of the V-belt suspending rollers 16 and 18, and the concave peripheral groove 27 is trapezoidal and approximately V-shape in cross section. And, three flanges 28 are protruding from each of the rollers 16 and 18 as outer brims, and the concave peripheral groove 27 is formed between the neighboring flanges 28 (refer to FIG. 6 and FIG. 12).

Figure 6:
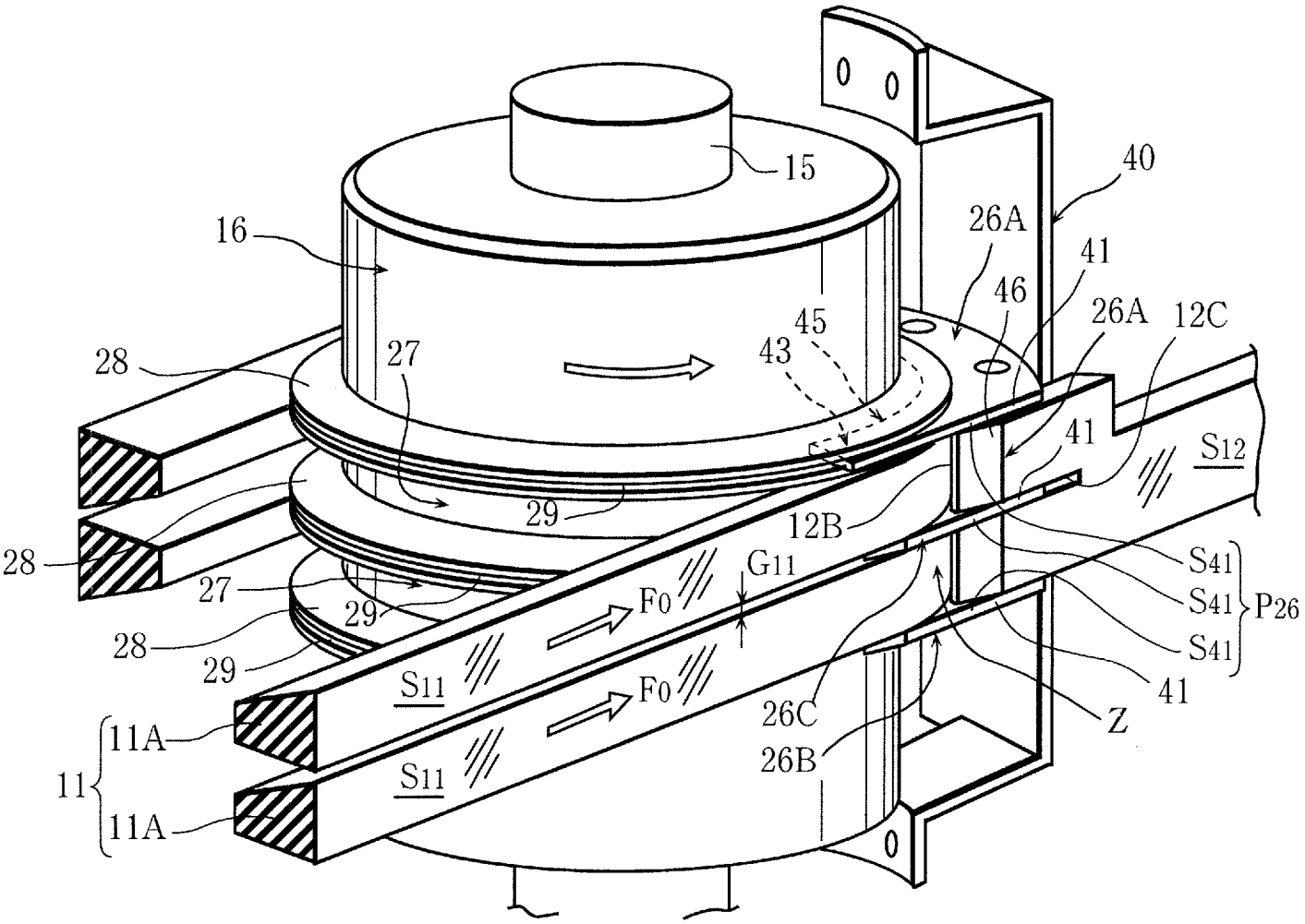
FIG. 6 is a perspective view of a principal portion.
Figure 12:
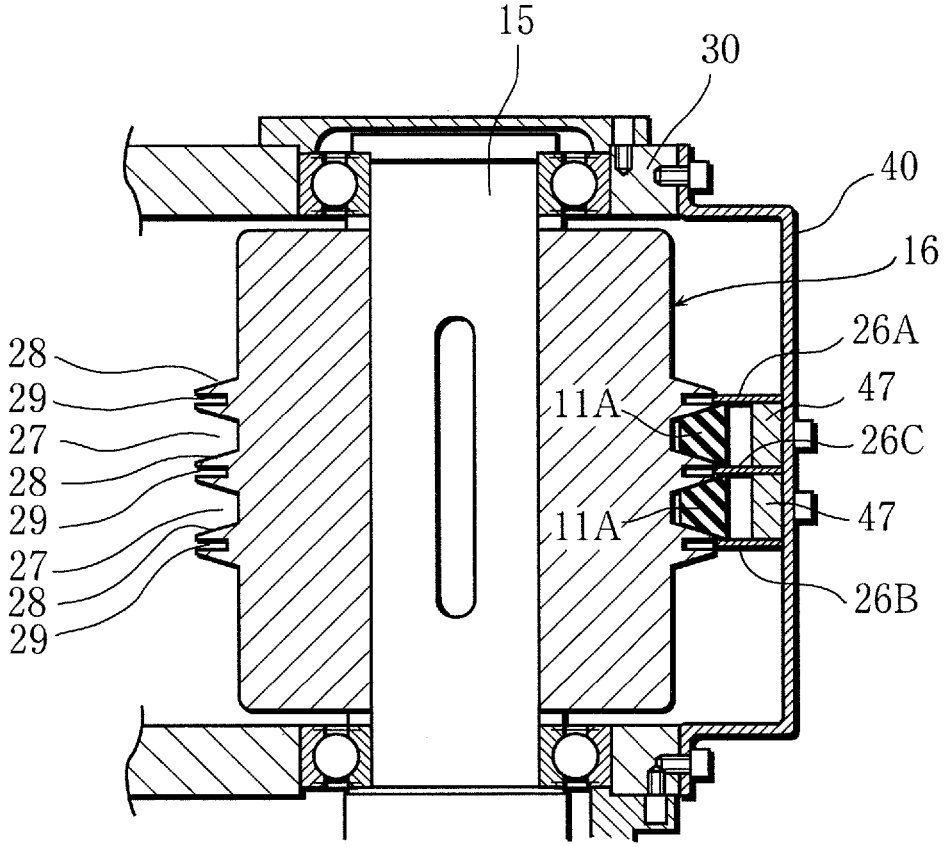
FIG. 12 is a cross-sectional view of a principal portion.

Among the four rollers 16 and 18, in the rollers 16 near the work transfer area Z, corresponding to the driving rollers 16 in figures, an escape slit portion 29 is formed from a peak of the flange 28 of steep trapezoidal cross section on a face at right angles with the axis (refer to FIG. 12, FIG. 5, and FIG. 6).

Figure 10:
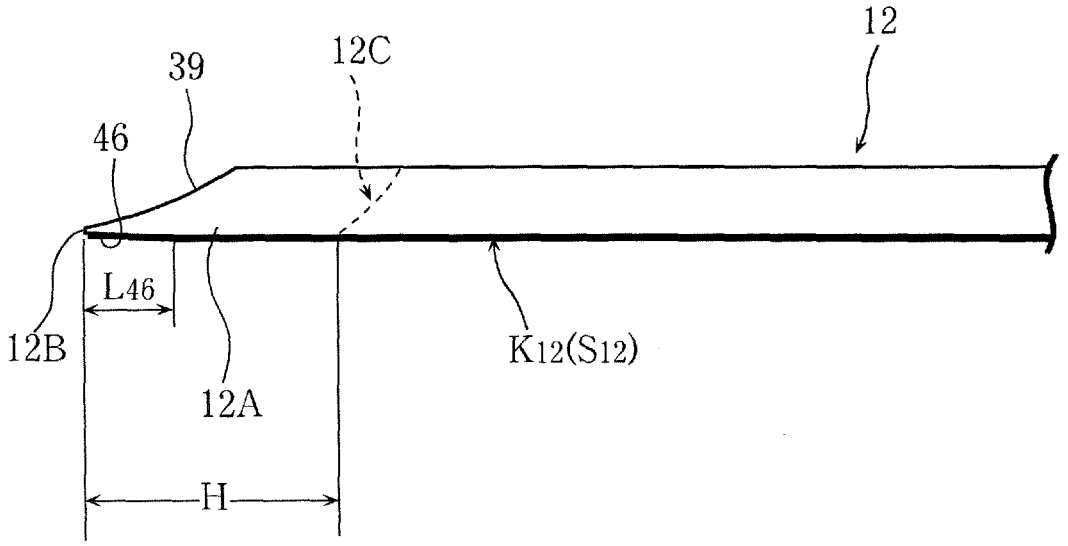
FIG. 10 is a top view of a principal portion of the work guiding plate.
Figure 11:
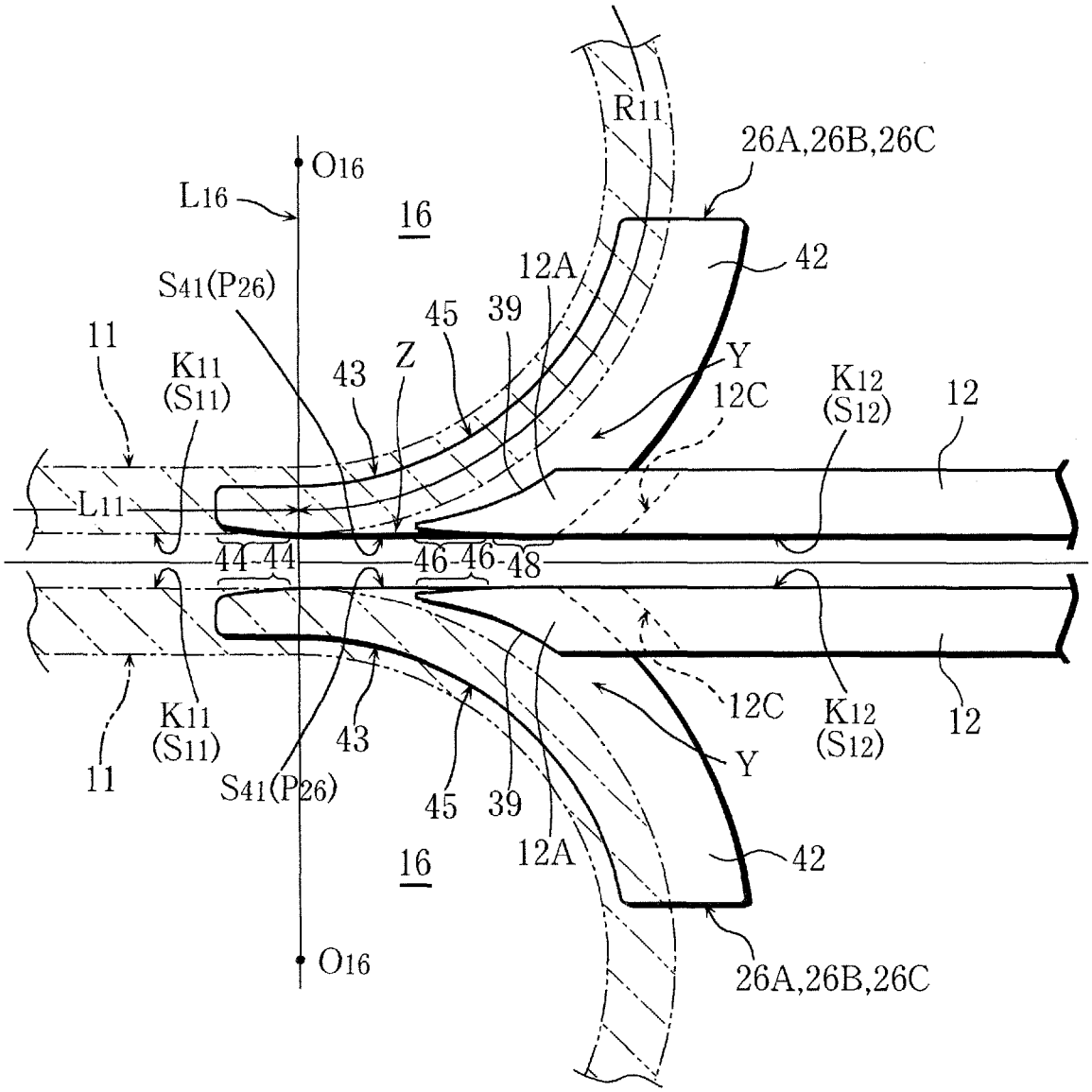
FIG. 11 is an explanatory top view of construction of a principal portion.

And, each of the work guiding plates 12 is extended on an upstream end to come close to a curved outer peripheral face of the belt 11 suspended on the roller 16, and formed into a concave portion 39 arc-shaped in top view as shown in FIG. 10, FIG. 11, and FIG. 5. The dimension (range) along the work feeding direction of the work transfer area Z can be reduced by an extended portion 12A extended as described above. And, each of the work guiding plates 12 is a belt plate wide on the upper and lower ends. A slit portion 12C straight in side view is formed from an upstream end portion 12B (of the extended portion 12A) of each of the work guiding plates 12.

Figure 7:
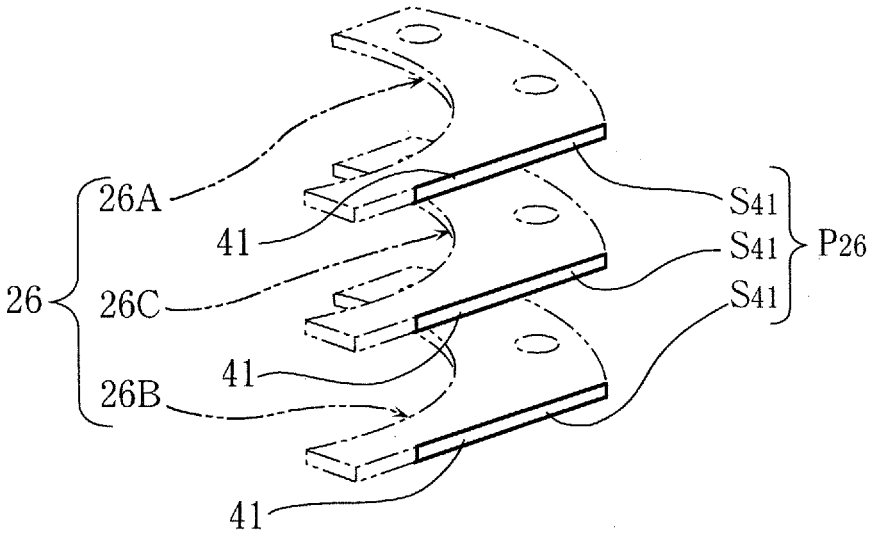
FIG. 7 is an explanatory perspective view of a principal portion.
Figure 13:
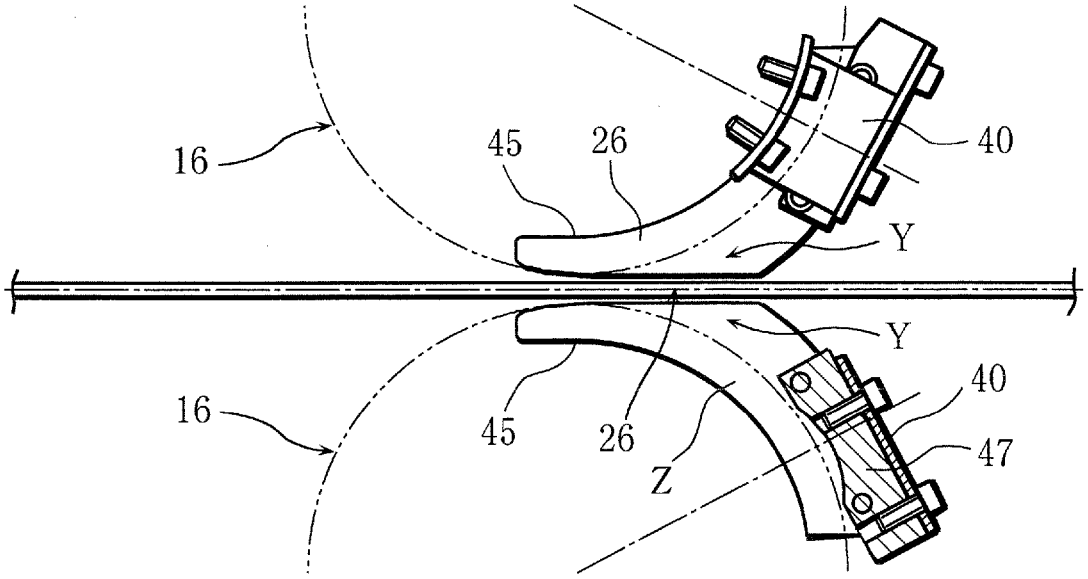
FIG. 13 is a top view of a principal portion with partial cross section.
Figure 14:
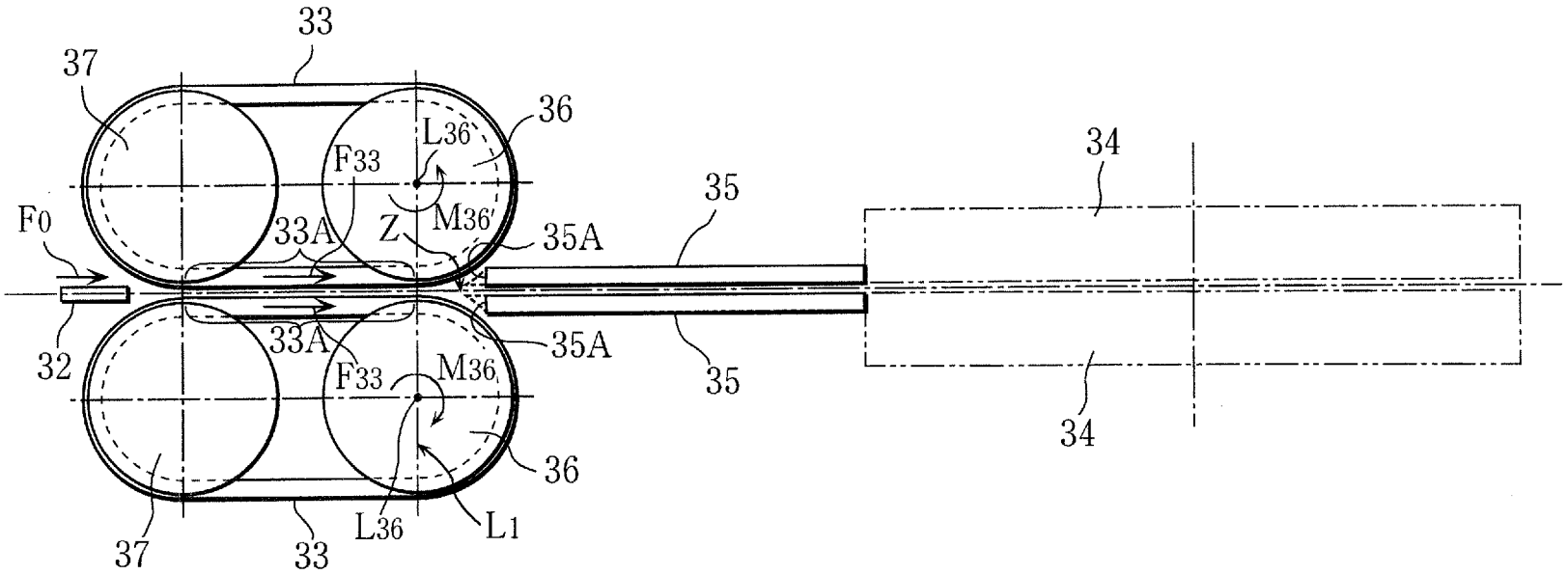
Fig. 14 PRIOR ART
FIG. 14 is a top view showing a conventional example.

Next, the work falling prevention member 26, as shown in FIG. 7, FIG. 12, and FIG. 13, has a parallel middle plate 26C, an upper plate 26A, and a lower plate 26B, the middle plate 26C, the upper plate 26A, and the lower plate 26B are united (unitized) with a spacer 47, further, as shown in FIG. 12, FIG. 13, FIG. 1, FIG. 4, and FIG. 6, the unit is fixed to a fixed holding frame 30 to hold the rollers 16 and 18 by an attachment member 40. It is preferable to form the three plates 26A, 26B, and 26C into the same configuration.

The middle plate 26C of the work falling prevention member 26 is inserted to the gap $G_{11}$ of the endless V-belts 11 from a reverse side of the work runway. And middle plate 26C is inserted to the slit portion 12C of the work guiding plate 12 from the reverse side of the work runway. And, the upper plate 26A is disposed near an upper face of the extended portion 12A of the work guiding plate 12, and the lower plate 26B is disposed near a lower face of the extended portion 12A of the work guiding plate 12.

Figure 8:
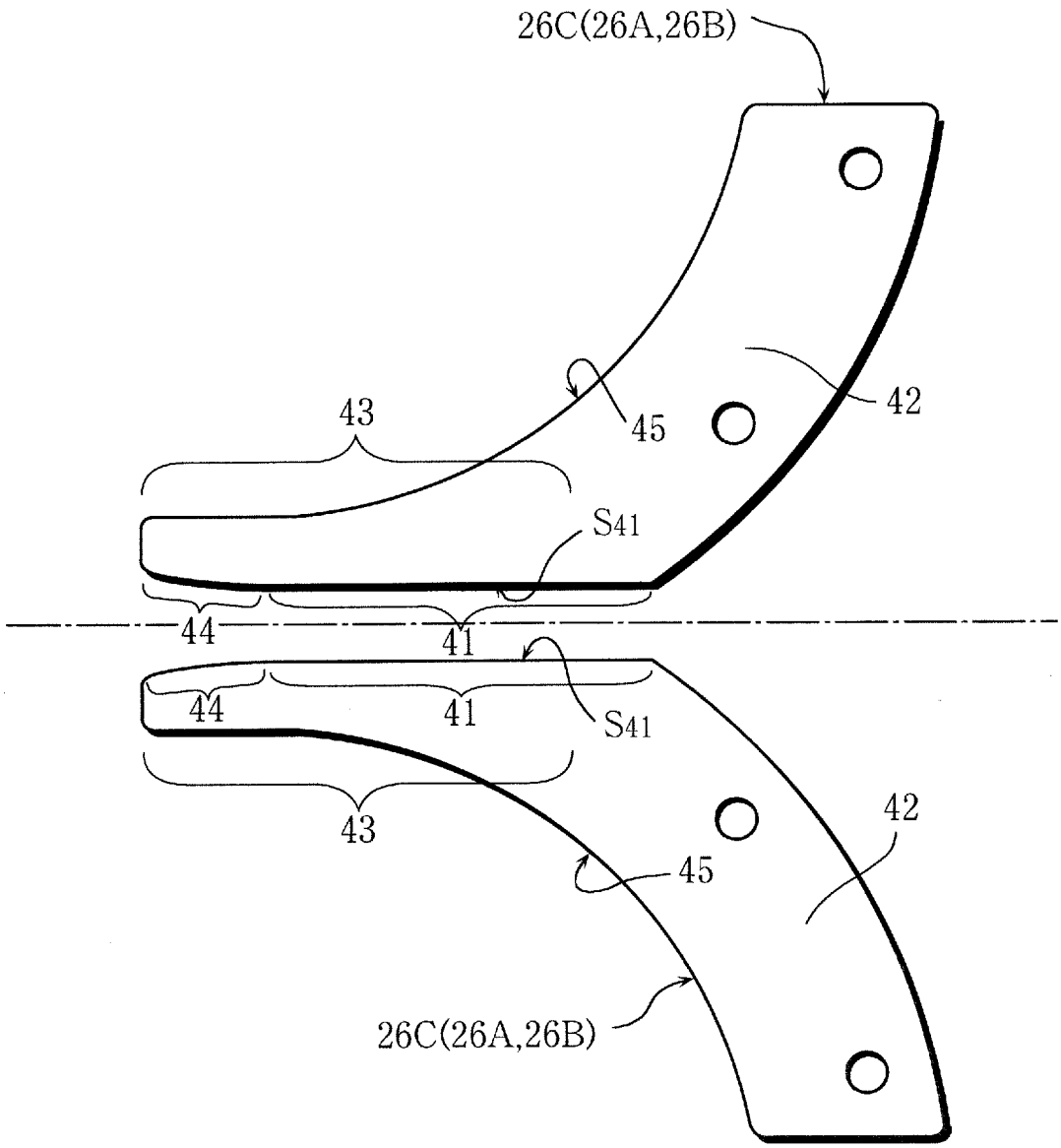
FIG. 8 is an enlarged schematic top view of a principal portion.

In FIG. 7 and FIG. 8, and in FIG. 6, a work falling prevention guiding face $P_{26}$, on which the work falling prevention member 26 actually contacts the work 10, is formed with end faces $S_{41}$ of a straight portion 41 (refer to portions shown with solid lines in FIG. 7) formed on an outline of the middle plate 26C, the upper plate 26A, and the lower plate 26B.

Each of the plates 26C, 26A, and 26B is composed of an arc plate base portion 42 and an extended portion 43 of which width dimension is gradually decreasing from the forth end portion of the arc plate base portion 42. That is to say, the extended portion 43 (of which width dimension is gradually decreasing) is formed with the straight portion 41 straightly cut on an extended arc line of an arc peripheral line of the arc plate base portion 42 and a work interference escape line 44 arc-shaped or straight from the forth end of the straight portion 41. The base portion 42 and the extended portion 43 have (continuous) inner peripheral end edges 45 of the same diameter.

The escape slit portion 29 is formed on the flange 28 of the roller 16 near the work transfer area Z among the V-belt suspension rollers 16 and 18 as described above. The inner peripheral end edge 45 of each of the plates 26C, 26A, and 26B is inserted (under non contact state) to the escape slit portion 29 (as shown in FIG. 5, FIG. 6, and FIG. 11).

As described above, the extended portion 43 can be reinforced by increased area (width dimension) of each of the extended portions 43 in top view by insertion of the inner peripheral end edge 45 of each of the plates 26C, 26A, and 26B to the escape slit portion 29 of the flange 28 of the roller 16.

The V-belt 11, as shown in FIG. 5, etc., is ellipse (athletic track shape) composed of parallel straight portions $L_{11}$ and a pair of half-circle arc portions $R_{11}$.

The extended portions 43 of each of the plates 26C, 26A, and 26B can be extended sufficiently long from a radial outer side of the V-belt 11 suspended on the roller 16 and from a wedge-shaped corner portion Y on the reverse side (of the work runway) of the work guiding plate 12 as to reach for the straight portion $L_{11}$, or overlap with the straight portion $L_{11}$ for a small dimension.

The work falling prevention member 26 is described further in detail. The work falling prevention guiding face $P_{26}$ of the work falling prevention member 26 connects a work holding line $K_{11}$ composed of a pressing face $S_{11}$ on which the V-belt 11 presses the work 10 and gives the feed $F_0$ and straight in top view, and a guiding line $K_{12}$ composed of a sliding face $S_{12}$ on which the work guiding plate 12 slides on the work 10 and straight in top view to be in a straight line in top view (refer to FIG. 6, FIG. 11, etc.).

In other words, the work falling prevention member 26 is provided with the work falling prevention guiding face $P_{26}$ which connects the straight work holding line $K_{11}$ and the straight guiding line $K_{12}$ as to be in a straight line in top view. Therefore, the work falling prevention guiding face $P_{26}$ is straight in top view, and composed of the end faces $S_{41}$ of the upper plate 26A, the middle plate 26C, and the lower plate 26B. The above-mentioned straight portions 41 overlap in top view to form a straight line, the straight line $K_{11}$ on the upstream side and the straight line $K_{12}$ on the downstream side are connected to form a straight line as a whole, and smooth feed of the work 10 is realized (without falling and hitching).

In the top view of FIG. 5, the extended portion 43 of the work falling prevention member 26 exists beyond a straight line $L_{16}$ connecting axis points $O_{16}$ of the rollers 16 from the downstream side. That is to say, a part of the straight portion $L_{11}$ of the V-belt 11 and a part of the extended portion 43 overlap in top view. Therefore, the work 10 is smoothly transferred and guided from the downstream end of the pressing face $S_{11}$ (work holding line $K_{11}$) to hold the work 10 to the guiding face $P_{26}$ (end face $S_{41}$) of the work falling prevention member 26.

As shown in FIG. 8 and FIG. 11, the work 10 is prevented from hitching to the forth end of the extended portion 43 by forming the work interference escape line 44 on the forth end of the extended portion 43.

Figure 9:
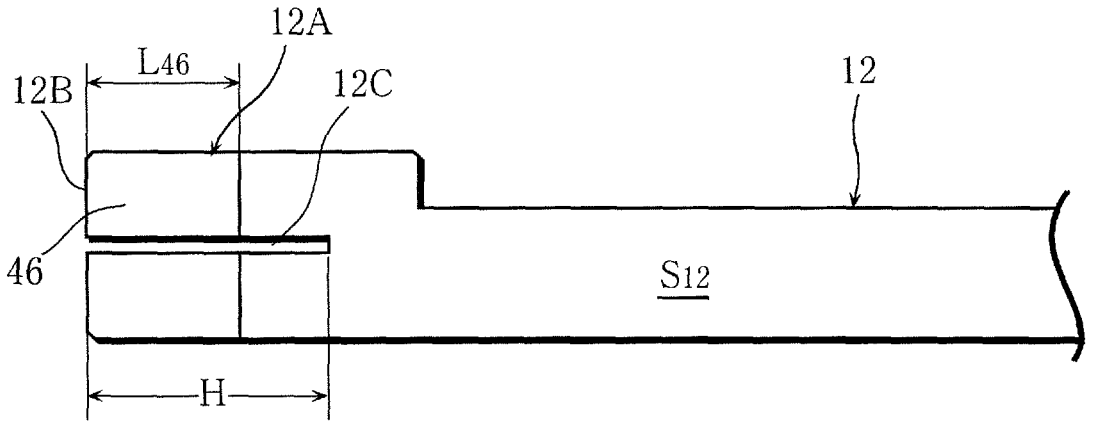
FIG. 9 is a side view of a principal portion of a work guiding plate.

And, as shown in FIG. 9 and FIG. 10, a sloped face 46 of a small dimension $L_{46}$ is formed from the upstream end portion 12B in the obverse side (sliding face $S_{12}$ side) of the work guiding plate 12 forming the runway of the work 10, the length dimension $L_{46}$ of the sloped face 46 is set to be smaller than a depth dimension H of the slit portion 12C, and each of the plates 26A, 26C, and 26B of the work falling prevention member 26 is deeply inserted to the slit portion 12C (refer to FIG. 6 and FIG. 11).

With this construction of deep insertion, an overlapping portion 48 of straight lines in top view is formed as shown in FIG. 11, and the work 10 is transferred very smoothly from the straight portion 41 of the work falling prevention member 26 to the sliding face $S_{12}$ (guiding line $K_{12}$) of the work guiding plate 12.

As described above, the downstream end portion of the straight portion $L_{11}$ of the V-belt 11 and the end edge on the work runway side of each of the plates 26A, 26C, and 26B of the work falling prevention member 26 form an overlapping portion, further, the end edge on the work runway side of each of the plates 26A, 26C, and 26B of the work falling prevention member 26 and the extended portion 12A of the work guiding plate 12 form the overlapping portion 48.

The work 10 ground by the horizontal double disc surface grinding machine of the present invention, a piston ring, a bearing race, a valve seat, and other various things not restricted to circular and ring, may be polygonal, ellipse, etc. And, The V-belt single bodies 11A may be three or more. In this case, the number of the plates 26A, 26C, and 26B is four or more. Especially, the number of the middle plates 26C inserted to the gap $G_{11}$ between the V-belt single bodies 11A may be increased to 2, 3, or more.

Figure 15:
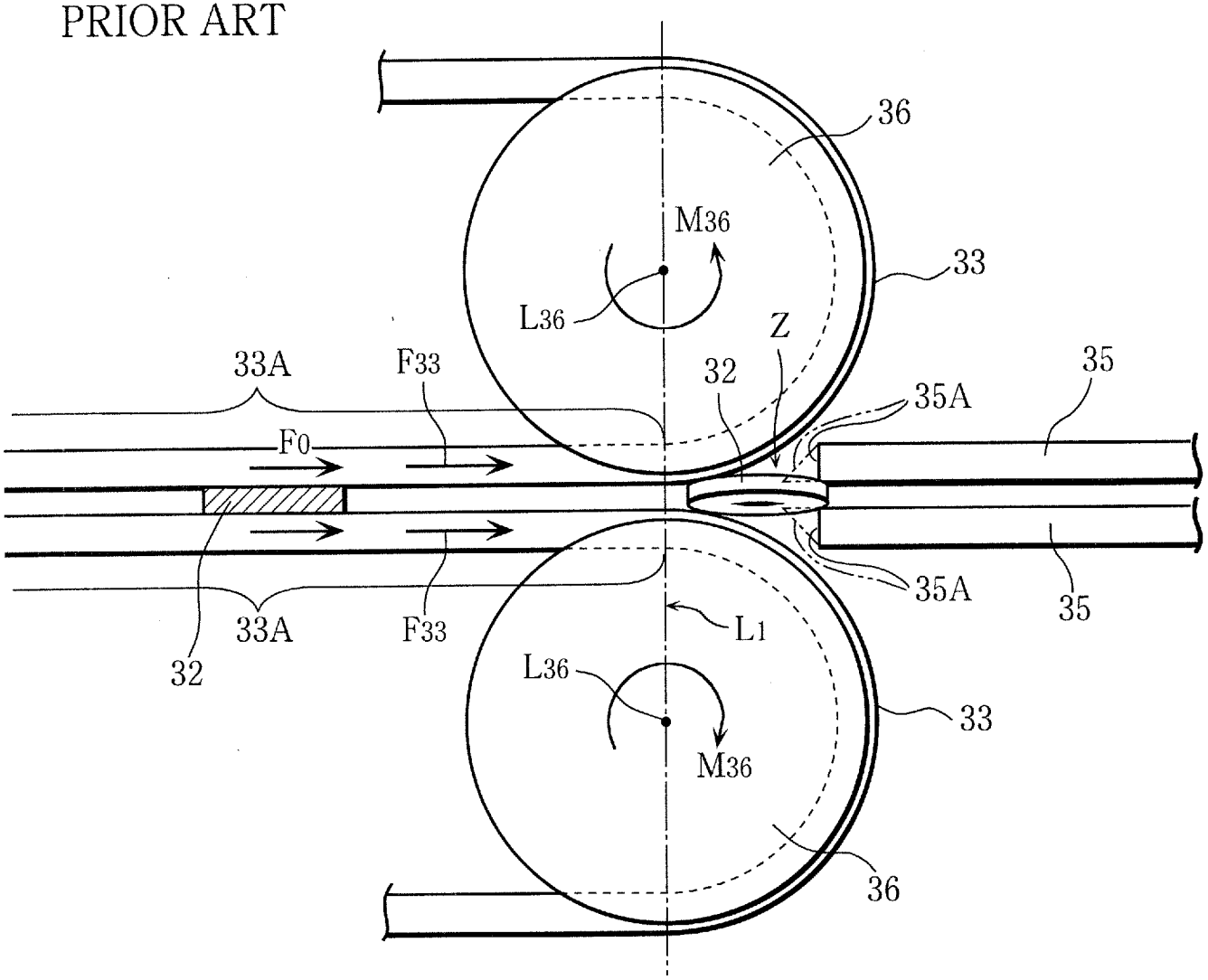
Fig. 15 PRIOR ART
FIG. 15 is an explanatory top view of a principal portion to explain problems of the conventional example.

In the present invention, falling of the work 10 in the work transfer area Z from the V-belt 11 to the work guiding plate 12 (as show in FIG. 15) and accompanying hitching of the guiding plate 12 to the upstream end portion can be prevented, conventional generation of facility halt can be remarkably reduced, and facility working time is improved because in a horizontal double disc surface grinding machine of through-feed type wherein the plate work 10 in vertical posture is induced between the grinding wheels 2 by the V-belts 11 and the work guiding plates 12, the work falling prevention member 26 is disposed in the work transfer area Z from the V-belt 11 to the work guiding plate 12. Further, defect in working accuracy generated along the facility halt can be reduced.

And, left and right side faces of work runway can be formed straight in top view without interval, the work 10 can be serially fed between the flat faces of the grinding wheels 2 smoothly and keeping normal posture without stopping and falling (even in a case of very small work 10) because in a horizontal double disc surface grinding machine of through-feed type provided with the pair of endless V-belts 11, holding the plate work 10 in vertical posture on left and right and giving feed F.sub.0, and the pair of work guiding plates 12, receiving and guiding the work 10 in vertical posture between grinding wheels 2, the work falling prevention member 26 is disposed in the work transfer area Z from the V-belt 11 to the work guiding plate 12, and, the work falling prevention member 26 is provided with the work falling prevention guiding face P.sub.26 to connect the work holding line K.sub.11 straight in top view and formed with the pressing face S.sub.11 on which the V-belts 11 hold the work 10 to a guiding line K.sub.12 straight in top view and formed with the sliding face S.sub.12 on which the work guiding plate 12 slides on the work 10.

Therefore, conventional generation of facility halt can be remarkably reduced, and facility working time is improved. Further, defect in working accuracy generated along the facility halt can be reduced.

And, the works 10 of small to large dimensions can be certainly and smoothly fed to the grinding wheels side without falling and hitching because each of the endless V-belts 11 is composed of plural units disposed on upper and lower positions to be parallel with the predetermined gap $G_{11}$, the slit portion 12C is formed on each of the work guiding plates 12 from the upstream end portion 12B, the work falling prevention member 26 has the middle plate 26C, inserted to the gap $G_{11}$ and the slit portion 12C, and the upper plate 26A and the lower plate 26B disposed near the upper face and the lower face of the V-belt 11 respectively and having the same configuration as the middle plate 26C, and, the work falling prevention guiding face $P_{26}$ is composed of end faces $S_{41}$ of the straight portions 41 formed of a part of outlines of the middle plate 26C, the upper plate 26A, and the lower plate 26B. Further, the work 10 can be serially transferred from the V-belt 11 to the work falling prevention guiding face $P_{26}$, further to the work guiding plate 12 extremely smoothly, and hitching and falling of the work 10 can be certainly prevented.

And, even if the work 10 collides with the upstream end portion of the extended portion 43, the extended portion 43 is not easily deformed, interference with the V-belt 11 is prevented, and the work 10 is fed to the grinding wheels 2 with stable normal posture for a long operation period because on the roller 16 near the work transfer area Z among the V-belt suspension rollers 16 and from which flanges 28 forming the concave peripheral groove 27 for V-belt suspension are protruding, the escape slit portion 29 is formed on the flange 28, and areas of extended portions 43 of the middle plate 26C, the upper plate 26A, and the lower plate 26B are increased in top view by partial insertion of the middle plate 26C, the upper plate 26A, and the lower plate 26B to the escape slit portions 29 to reinforce the extended portions 43. Especially, the extended portion 43 can be extended until overlapped with the straight portion $L_{11}$ of the V-belt 11, the transfer from the V-belt 11 to the work falling prevention member 26 is made certain and smooth.

While preferred embodiments of the present invention have been described in this specification, it is to be understood that the invention is illustrative and not restrictive, because various changes are possible within the spirit and indispensable features.

What is claimed is:

1. A horizontal double disc surface grinding machine of through-feed type provided with a pair of endless V-belts, holding a plate work in vertical posture on left and right and giving feed, and a pair of work guiding plates, receiving and guiding the work in vertical posture between grinding wheels, comprising a construction in which:

a work falling prevention member is disposed in a work transfer area from the V-belts to the work guiding plate;

the work falling prevention member is provided with a work falling prevention guiding face to connect a work holding line straight in top view and formed with a pressing face on which the V-belts hold the work to a guiding line straight in top view and formed with a sliding face on which the work guiding plate slides on the work;

each of the endless V-belts is composed of plural units disposed on upper and lower positions to be parallel with a predetermined gap;

a slit portion is formed on each of the work guiding plates from an upstream end portion;

the work falling prevention member has a middle plate, inserted to the gap and the slit portion, and an upper plate and a lower plate disposed near an upper face and a lower face of the V-belt respectively and having the same configuration as the middle plate; and the work falling prevention guiding face is composed of end faces of straight portions formed of a part of outlines of the middle plate, the upper plate, and the lower plate.

2. A horizontal double disc surface grinding machine of through-feed type provided with a pair of endless V-belts, holding a plate work in vertical posture on left and right and giving feed, and a pair of work guiding plates, receiving and guiding the work in vertical posture between grinding wheels, comprising a construction in which:

a work falling prevention member is disposed in a work transfer area from the V-belts to the work guiding plate;

the work falling prevention member is provided with a work falling prevention guiding face to connect a work holding line straight in top view and formed with a pressing face on which the V-belts hold the work to a guiding line straight in top view and formed with a sliding face on which the work guiding plate slides on the work;

each of the endless V-belts is composed of plural units disposed on upper and lower positions to be parallel with a predetermined gap;

a slit portion is formed on each of the work guiding plates from an upstream end portion;

the work falling prevention member has a middle plate, inserted to the gap and the slit portion, and an upper plate and a lower plate disposed near an upper face and a lower face of the V-belt respectively and having the same configuration as the middle plate;

the work falling prevention guiding face is composed of end faces of straight portions formed of a part of outlines of the middle plate, the upper plate, and the lower plate; and on a roller near the work transfer area among V-belt suspension rollers from which flanges forming a concave peripheral groove for V-belt suspension are protruding, an escape slit portion is formed on the flange, and areas of extended portions of the middle plate, the upper plate, and the lower plate are increased in top view by partial insertion of the middle plate, the upper plate, and the lower plate to the escape slit portions to reinforce the extended portions.

* * * * *